US011821064B2

(12) United States Patent
Xu et al.

(10) Patent No.: US 11,821,064 B2
(45) Date of Patent: Nov. 21, 2023

(54) CU-BASED BULK METALLIC GLASSES IN THE CU—ZR—HF—AL AND RELATED SYSTEMS

(71) Applicant: Oregon State University, Corvallis, OR (US)

(72) Inventors: Donghua Xu, Corvallis, OR (US); Jaskaran Singh Saini, Corvallis, OR (US); Collin J. Palian, Corvallis, OR (US)

(73) Assignee: Oregon State University, Corvallis, OR (US)

( * ) Notice: Subject to any disclaimer, the term of this patent is extended or adjusted under 35 U.S.C. 154(b) by 133 days.

(21) Appl. No.: 17/508,056

(22) Filed: Oct. 22, 2021

(65) Prior Publication Data

US 2022/0056566 A1 Feb. 24, 2022

Related U.S. Application Data

(63) Continuation of application No. PCT/US2020/030096, filed on Apr. 27, 2020.

(60) Provisional application No. 62/841,052, filed on Apr. 30, 2019.

(51) Int. Cl.

| | |
|---|---|
| ***C22C 45/00*** | (2023.01) |
| ***C22C 45/10*** | (2006.01) |
| ***B22D 21/00*** | (2006.01) |

(52) U.S. Cl.

CPC ..... *C22C 45/001* (2013.01); *B22D 21/00* (2013.01); *C22C 45/10* (2013.01)

(58) Field of Classification Search

None

See application file for complete search history.

(56) References Cited

U.S. PATENT DOCUMENTS

| | | | | |
|---|---|---|---|---|
| 2004/0112475 | A1* | 6/2004 | Inoue | C22C 45/001 148/403 |
| 2006/0137772 | A1 | 6/2006 | Xu et al. | |
| 2006/0144476 | A1 | 7/2006 | Inoue et al. | |
| 2008/0190521 | A1 | 8/2008 | Loffler et al. | |
| 2014/0111921 | A1 | 4/2014 | Zhang et al. | |
| 2014/0146453 | A1* | 5/2014 | Zhu | H01L 23/06 361/679.01 |
| 2015/0307975 | A1* | 10/2015 | Peker | C22C 45/10 148/403 |
| 2018/0044770 | A1* | 2/2018 | Zhang | C22C 1/11 |
| 2020/0308683 | A1* | 10/2020 | Xue | C22C 1/023 |

(Continued)

FOREIGN PATENT DOCUMENTS

| | | | |
|---|---|---|---|
| CN | 103949802 | | 7/2014 |
| CN | 105695901 | A * | 6/2016 |
| CN | 106244946 | A * | 12/2016 |

(Continued)

OTHER PUBLICATIONS

English translation of CN 105695901 (originally published Jun. 22, 2016), obtained from PE2E search.*

(Continued)

*Primary Examiner* — George Wyszomierski

(74) *Attorney, Agent, or Firm* — Klarquist Sparkman, LLP

(57) ABSTRACT

Cu-based bulk amorphous alloys in the quaternary Cu—Zr—Hf—Al alloy system are disclosed. A method of casting such alloys and articles comprising such alloys also are disclosed.

21 Claims, 4 Drawing Sheets

(56) References Cited

U.S. PATENT DOCUMENTS

2021/0102280 A1* 4/2021 Li ..... C22C 1/11

FOREIGN PATENT DOCUMENTS

| | | | | |
|---|---|---|---|---|
| CN | 106702292 | A | * | 5/2017 |
| CN | 109266946 | A | * | 1/2019 |
| CN | 109355602 | A | * | 2/2019 |

OTHER PUBLICATIONS

English translation of CN 106244946 (originally published Dec. 21, 2016), obtained from PE2E search.*
English translation of CN 106702292 (originally published May 24, 2017), obtained from PE2E search.*
English translation of CN 109266946 (originally published Jan. 21, 2019), obtained from PE2E search.*
English translation of CN 109355602 (originally published Feb. 19, 2019), obtained from PE2E search.*

* cited by examiner

CU-BASED BULK METALLIC GLASSES IN THE CU—ZR—HF—AL AND RELATED SYSTEMS

CROSS REFERENCE TO RELATED APPLICATION

This application is a continuation of International Application No. PCT/US2020/030096, filed on Apr. 27, 2020, which was published in English under PCT Article 21(2), which in turn claims the benefit of the earlier filing date of U.S. Patent Application No. 62/841,052, filed on Apr. 30, 2019, both of which prior applications are incorporated by reference herein in their entirety.

FIELD

The present invention is directed to novel bulk solidifying amorphous alloy compositions, and more specifically to Cu-based bulk solidifying amorphous alloy compositions.

BACKGROUND

Conventional metals or alloys comprise numerous crystal grains and crystal-related defects such as grain boundaries, dislocations and vacancies/voids. Amorphous alloys, also known as metallic glasses, are free of crystal grains and crystal-related defects, and because of this, possess many properties far superior to conventional alloys. Examples of such properties are theoretical-limit approaching strength, high hardness, high elastic strain limit, and high wear and corrosion resistances.

Early (1960-1980s) metallic glasses were produced by rapid liquid quenching only in the forms of powders or thin films/foils/ribbons with at least one dimension below 100 micrometers. The restricted size in at least one dimension was needed in order to achieve the high cooling rate (>$10^{5}$° C./s) required to bypass crystallization and form the glassy structure. If all dimensions, in particular, the smallest dimension exceeds a threshold size, which is termed the critical casting thickness (or, diameter), partial or complete crystallization would occur. In the early 1990s, some Zr-based, Mg-based and La-based alloys were found to be able to form bulk amorphous products with the critical casting thickness exceeding a few millimeters. These alloys were the first of what is now known as bulk metallic glasses or bulk amorphous alloys. Bulk metallic glasses possess the superior properties common to all amorphous alloys and yet have much lower requirements on the cooling rate that enable fabrication of more practical-sized commercial articles. In addition, bulk metallic glass articles can be cast in near-net shape due to the lack of abrupt crystallization-induced volume reduction in conventional alloys. This eliminates or significantly reduces the post-fabrication machining costs.

Although a large number of bulk metallic glasses have been developed since 1990s, only a handful of them have passed the mark of 15 mm in the critical casting thickness. This not only limits the material choices for fabricating large metallic glass articles with all dimensions >15 mm, but also demands stringent control (in terms of, e.g., oxygen free environment, impurity level) over fabrication conditions for moderate-sized articles. There is a clear need to develop new metallic glass compositions with the critical casting thickness above 15 mm.

SUMMARY

The present invention concerns bulk amorphous alloys based on a Cu—Zr—Hf—Al quaternary system that can form by conventional liquid-solidification methods (e.g., casting, water quenching). In one exemplary embodiment, the Cu—Zr—Hf—Al system is extended to higher alloys by adding one or more alloying elements. Disclosed embodiments also concern a method of forming these alloys into three-dimensional bulk articles, while retaining a substantially amorphous atomic structure. In such an embodiment, "three dimensional" refers to an article having dimensions of at least 0.5 mm in each dimension, and preferably at least 1.0 mm in each dimension. The term "substantially" as used herein in reference to the amorphous metal alloy means that the metal alloys are at least fifty percent amorphous or greater by volume, such as sixty percent amorphous, seventy percent amorphous, eighty percent amorphous, or ninety percent amorphous. The percentage of the amorphous content can be accurately determined by measuring crystallization enthalpy upon heating in a calorimeter. Preferably the metal alloy is at least ninety-five percent amorphous and most preferably about one hundred percent amorphous by volume.

The foregoing and other objects, features, and advantages of the invention will become more apparent from the following detailed description, which proceeds with reference to the accompanying figures.

DETAILED DESCRIPTION

Figure 1:
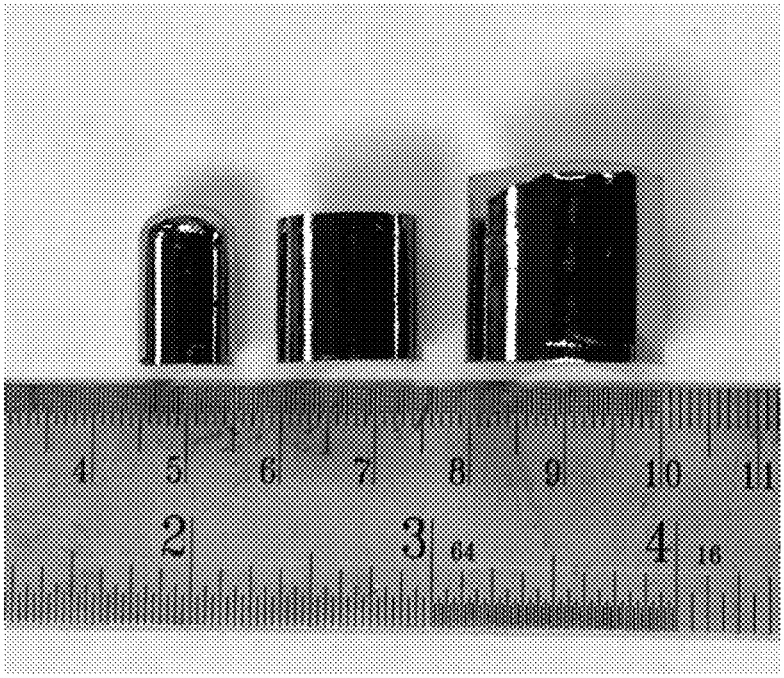
FIG. 1 is a digital image of an embodiment of a Cu—Zr—Hf—Al alloy according to the present invention in the form of cylindrical rods of different diameters fabricated by tilt casting.

The disclosed embodiments concern novel Cu-based bulk solidifying amorphous alloy compositions based on the Cu—Zr—Hf—Al quaternary system and the extension of this quaternary system to higher order alloys by the addition of one or more alloying elements, and embodiments of a method of making such alloys and casting such alloys to form cast articles comprising disclosed alloys.

I. Explanation of Terms and Definitions

The following explanations of terms are provided to better describe the present disclosure and to guide those of ordinary skill in the art to practice the present disclosure.

As used herein, "comprising" means "including."

The singular forms "a" or "an" or "the" include plural references unless the context clearly dictates otherwise.

The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used to practice or test the present disclosure, suitable methods and materials are described below. The materials, methods, and examples are illustrative only and are not to be construed as limiting the scope of the invention to the particular disclosed materials, methods and examples. Other features of the disclosure will be apparent to a person of ordinary skill in the art from the following detailed description and the claims.

Disclosed numerical ranges refer to each discrete point within the range, inclusive of endpoints, unless otherwise noted.

Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods as known to those of ordinary skill in the art. When directly and explicitly distinguishing embodiments from discussed prior art, the embodiment numbers are not approximations unless the word "about" is recited.

Alcohol: An organic compound including at least one hydroxyl group. Alcohols may be monohydric (including one —OH group) or polyhydric (including two or more —OH groups). The organic portion of the alcohol may be aliphatic, more typically alkyl.

Alkyl: A hydrocarbon group having a saturated carbon chain. The chain may be cyclic, branched or unbranched. Examples, without limitation, of alkyl groups include methyl, ethyl, propyl, butyl, pentyl, hexyl, heptyl, octyl, nonyl and decyl. Lower alkyl means that the chain includes 1-10 ($C_{1-10}$) carbon atoms.

Alloy: A solid or liquid mixture of two or more metals, or of one or more metals with certain nonmetallic elements (e.g., carbon steels).

Amorphous: Non-crystalline, having no or substantially no lattice structure. Some solids or semisolids, such as glasses, rubber, and some polymers, are also amorphous. Amorphous solids and semisolids lack a definite crystalline structure and a well-defined melting point.

Ketone: A carbonyl-bearing substituent having a formula

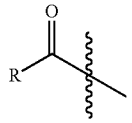

where R is virtually any group, including aliphatic, substituted aliphatic, aryl, arylalkyl, heteroaryl, etc.

Metallic Glass: A solid metallic material, typically an amorphous alloy, with a disordered atomic-scale structure that is substantially free of crystal grains and crystal-related defects.

II. Alloy Compositions

Although a fairly wide range of compositions in the quaternary system may be utilized to produce fully amorphous bulk articles, a range of Cu content from about 40 to about 55 atomic percentage, a range of Zr content from about 15 to about 45 atomic percentage, a range of Hf content from about 3 to about 30 atomic percentage, and a range of Al content from about 4 to about 10 atomic percentage are preferably utilized. To increase the ease of obtaining fully amorphous bulk cast articles and for increased processability, a formulation having a concentration of Cu in the range of from about 43 to about 49 atomic percentage, Zr in the range of from about 23 to about 42 atomic percentage, Hf in the range of from about 5 to about 24 atomic percentage, and Al in the range of from about 6 to about 8 atomic percentage is preferred. Still more preferable is a Cu—Zr—Hf—Al alloy having a Cu content from about 45 to about 47 atomic percentage, a Zr content from about 30 to about 35 atomic percentage, a Hf content from about 11 to about 17 atomic percentage, and an Al content from about 7 to about 8 atomic percentage.

Although only combinations of Cu, Zr, Hf, and Al have been discussed thus far, it should be understood that other elements can be added to improve the ease of casting the new Cu-based alloys into larger bulk articles or to increase the processability of the alloys. Additional alloying elements of potential interest are Mn, Fe, Co, Ni, Pd, Pt and Au, which can each be used as fractional replacements for Cu; Ti, Y, V, Nb, Ta, Cr, Mo, and W, which can be used as fractional replacements for Zr or Hf; and B, Ge, Sb and Si, which can be used as fractional replacements for Al.

It should be understood that the addition of the above mentioned additive alloying elements may have a varying degree of effectiveness for improving the critical casting thickness or processability of the new Cu-based alloys in the compositional ranges described above and below, and that this should not be taken as a limitation of the current invention.

Given the above discussion, in general, the Cu-based alloys of the current invention can be expressed by the following general formula (where a, b, c are in atomic percentages and x, y, z are in fractions of whole): $(Cu_{1-x}TM_x)_a((Zr,Hf)_{1-y}ETM_y)_b(Al_{1-z}AM_z)_c$, where a is in the range of from 40 to 55, b is in the range of 40 to 54, and c is in the range of 4 to 10 in atomic percentages; ETM is an early transition metal selected from the group of Ti, Y, V, Nb, Ta, Cr, Mo, and W; TM is a transition metal selected from the group of Mn, Fe, Co, Ni, Pd, Pt and Au; and AM is an additive material selected from the group of B, Ge, Sb and Si. In such an embodiment the following constraints are given for the x, y and z fraction: $0 \le x < 0.3$; $0 \le y < 0.3$; $0 \le z < 0.3$; and $0 \le x+y+z < 0.5$; and furthermore the Zr content is more than 15 atomic percent and the Hf content is more than 3 atomic percent.

Preferably, the Cu-based alloys of the current invention are given by the formula: $(Cu_{1-x}TM_x)_a((Zr,Hf)_{1-y}ETM_y)_b(Al_{1-z}AM_z)_c$, where a is in the range of from 43 to 49, b is in the range of 44 to 50, and c is in the range of 6 to 8 in atomic percentages; ETM is an early transition metal selected from the group of Ti, Y, V, Nb, Ta, Cr, Mo, and W; TM is a transition metal selected from the group of Mn, Fe, Co, Ni, Pd, Pt and Au; and AM is an additive material selected from the group of B, Ge, Sb and Si. In such an embodiment the following constraints are given for the x, y and z fraction: $0 \le x < 0.2$; $0 \le y < 0.2$; $0 \le z < 0.2$; and $0 \le x+y+$ z<0.3; and under the further constraint that the Zr content is more than 23 atomic percent and the Hf content is more than 5 atomic percent.

Still more preferably, the Cu-based alloys of the current invention are given by the formula: $(Cu_{1-x}TM_x)_a((Zr,Hf)_{1-y}ETM_y)_b(Al_{1-z}AM_z)_c$, where a is in the range of from 45 to 47, b is in the range of 45 to 49, and c is in the range of 7 to 8 in atomic percentages; ETM is an early transition metal selected from the group of Ti, Y, V, Nb, Ta, Cr, Mo, and W; TM is a transition metal selected from the group of Mn, Fe, Co, Ni, Pd, Pt and Au; and AM is an additive material selected from the group of B, Ge, Sb and Si. In such an embodiment the following constraints are given for the x, y and z fraction: $0 \le x < 0.1$; $0 \le y < 0.1$; $0 \le z < 0.1$; and $0 \le x+y+z < 0.2$; and under the further constraint that the Zr content is more than 30 atomic percent and the Hf content is more than 11 atomic percent.

For increased critical casting thickness and processability, the above mentioned alloys are preferably selected to have four or more elemental components. It should be understood that the addition of the above-mentioned additive alloying elements may have a varying degree of effectiveness for improving the critical casting thickness or processability of the new Cu-based alloys in the compositional ranges described above and below, and that this should not be taken as a limitation of the current invention.

Other alloying elements not mentioned above, e.g., alkali metals—Li, Na, K, Rb, Cs), alkaline metals—Be, Mg, Ca, Sr, Ba, and post-transition metals—Ga, In, Sn, can also be added, generally without any significant effect on critical casting thickness or processability when their total amount is limited to less than 1%. However, a higher amount of other elements can cause a degradation in the critical casting thickness and processability of the alloys, and in particular when compared to the critical casting thickness and processability of the exemplary alloy compositions described below. The addition of these other alloying elements in small amounts (e.g. <0.5%) may improve the critical casting thickness and processability of alloy compositions with relatively small critical casting thickness of less than 10 mm. It should be understood that such alloying compositions are also included in the current invention.

Exemplary embodiments of the Cu-based alloys in accordance with the invention are described by the following:

In one exemplary embodiment of the innovation the Cu-based alloys have the following general formula: $Cu_{100-a-b-c}Zr_aHf_bAl_c$, where 15<a<45, 3<b<30, 4<c<10.

In one preferred embodiment of the innovation the Cu-based alloys have the following general formula: $Cu_{100-a-b-c}Zr_aHf_bAl_c$, where 23<a<42, 5<b<24, 6<c<8.

The most preferred embodiment of the quaternary Cu-based alloys have the following general formula: $Cu_{100-a-b-c}Zr_aHf_bAl_c$, where 30<a<35, 11<b<17, 7<c<8.

Alloys with these general formulations have been cast from the melt into copper molds, or water quenched when melted inside a quartz tube, to form fully amorphous cylindrical rods of diameters up to 28.5 mm (not necessarily the upper limit of the critical casting thickness of the alloys). Examples of these bulk metallic glass forming alloys are provided by Table 1 below.

TABLE 1

| ALLOY COMPOSITION (AT. %) | CRITICAL CASTING THICKNESS (MM) | $T_G$ (° C.) | $T_X$ (° C.) | ΔTSC (° C.) |
|---|---|---|---|---|
| $Cu_{46}Zr_{42}Hf_5Al_7$ | 12-14 | 426 | 486 | 60 |
| $Cu_{46}Zr_{39}Hf_8Al_7$ | 15-17 | 432 | 494 | 62 |
| $Cu_{46}Zr_{35}Hf_{12}Al_7$ | >22 | 435 | 499 | 64 |
| $Cu_{46}Zr_{33.5}Hf_{13.5}Al_7$ | >28.5 | 443 | 503 | 60 |
| $Cu_{46}Zr_{32}Hf_{15}Al_7$ | >24 | 445 | 506 | 61 |
| $Cu_{46}Zr_{30}Hf_{17}Al_7$ | 20-22 | 441 | 508 | 67 |
| $Cu_{46}Zr_{27}Hf_{20}Al_7$ | 15-17 | 449 | 520 | 71 |
| $Cu_{46}Zr_{23.5}Hf_{23.5}Al_7$ | 12-14 | 453 | 522 | 69 |
| $Cu_{48}Zr_{31.5}Hf_{13.5}Al_7$ | 20-22 | 448 | 508 | 60 |
| $Cu_{44}Zr_{33.5}Hf_{15.5}Al_7$ | 15-17 | 433 | 500 | 67 |
| $Cu_{46}Zr_{31.5}Hf_{13.5}Al_7Ti_2$ | >25 | 441 | 489 | 48 |
| $Cu_{43}Ni_3Zr_{33.5}Hf_{13.5}Al_7$ | >25 | 439 | 497 | 58 |

Figure 2:
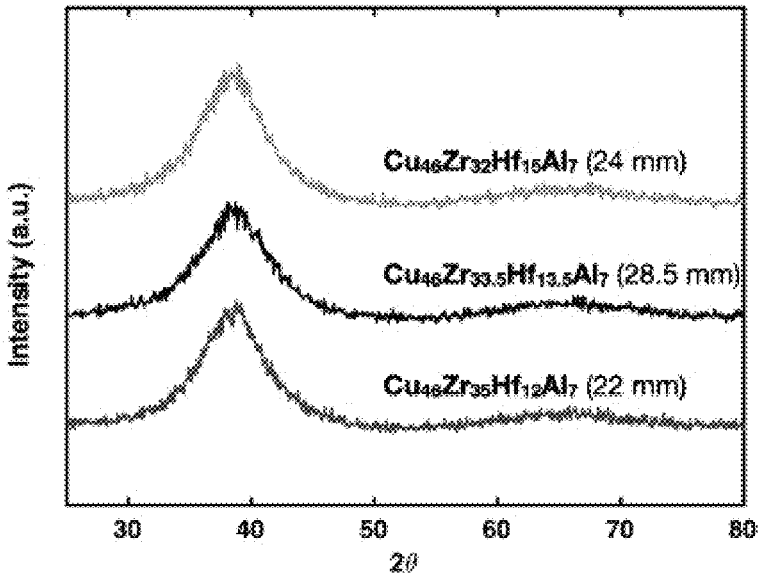
FIG. 2 is a set of X-ray diffraction patterns from large-diameter cast rods of exemplary alloys according to the present invention, all displaying only two broad maxima within a wide range of angles without any sharp Bragg peaks, establishing that the alloy had a fully amorphous structure.

Table 1 provides the critical casting thickness (rod diameter) for obtaining fully amorphous rods (a photo of three exemplary rods is provided in FIG. 1). For those listings with two numbers, the smaller number is the diameter of a rod confirmed to be fully amorphous, and the greater number is either the diameter of a rod confirmed to be partially crystallized or the best estimate of the upper limit of the critical casting thickness. The amorphous or (partially) crystalline structure was determined by X-ray diffraction spectra, some examples being shown in FIG. 2 for three large-diameter (>20 mm) fully amorphous rods.

Figure 3:
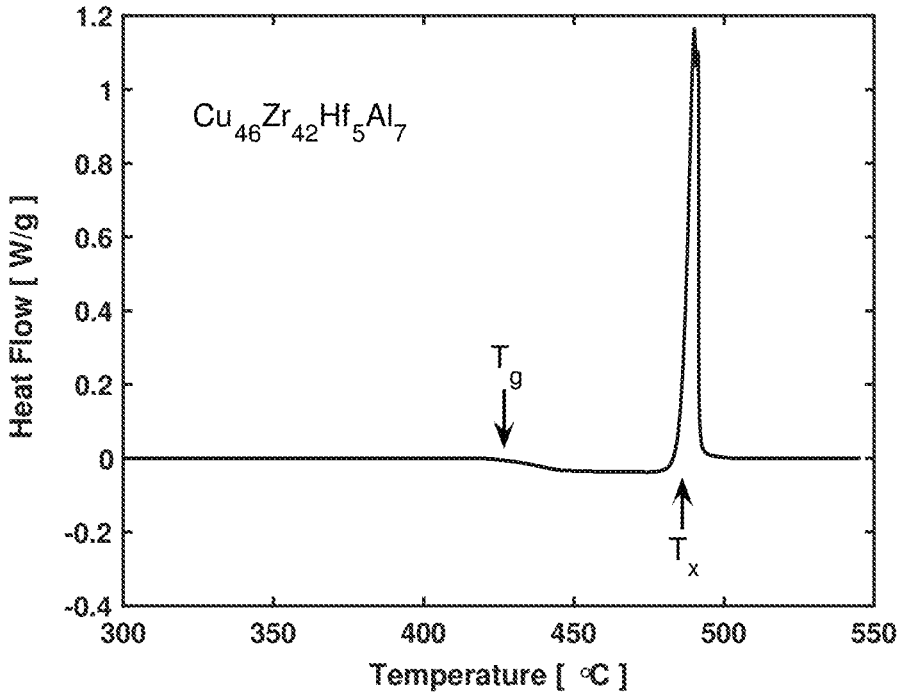
FIG. 3 is a differential scanning calorimetry (DSC) scan of an exemplary alloy according to the present invention showing glass transition and crystallization characteristic of metallic glasses.

Also listed in Table 1 are the glass transition temperature ($T_g$) and the crystallization temperature ($T_x$) of selected alloys that were determined using the standard calorimetric technique DSC (differential scanning calorimetry) at a heating rate of 5° C./min. A typical example of DSC scans for fully amorphous cast alloys is provided by FIG. 3, which shows an endothermic glass transition at ~426° C., and an exothermic crystallization event started at ~486° C.

The interval between $T_g$ and $T_x$, known as the supercooled liquid region ΔTsc, is an important measure of the processability of amorphous alloys, since it indicates the stability of the viscous liquid regime of the alloy above the glass transition. The ΔTsc is also listed in Table 1 for those alloys with measured $T_g$ and $T_x$. A large ΔTsc is generally preferred since it increases the ease of thermoplastically processing an amorphous alloy upon reheating when this is desired. Many of the present new alloys exemplified by those provided by Table 1 have ΔTsc more than 60° C., which indicates that such alloys have a high processability.

The exact values of $T_g$, $T_x$ and ΔTsc depend on the heating rate used in a DSC scan. The values listed in Table 1 are for a heating rate of 5° C./minute and they are expected to increase when a higher heating rate (e.g., 20° C./minute) is employed.

To assess the strength of these new metallic glasses, Vickers hardness ($H_V$) measurements were performed on selected alloys. The $H_V$ data, along with estimated yield strength, are shown in Table 2. The yield strength was calculated based on the empirical scaling rule $\sigma_Y = H_V/3$, where Vickers hardness is first converted to the GPa units.

TABLE 2

| ALLOY COMPOSITION (AT. %) | $H_V$ (KG/MM$^2$) | YIELD STRENGTH (GPA) |
|---|---|---|
| $Cu_{46}Zr_{42}Hf_5Al_7$ | 552 | 1.8 |
| $Cu_{46}Zr_{39}Hf_8Al_7$ | 566 | 1.8 |

TABLE 2-continued

| ALLOY COMPOSITION (AT. %) | $H_V$ (KG/MM$^2$) | YIELD STRENGTH (GPA) |
|---|---|---|
| $Cu_{46}Zr_{35}Hf_{12}Al_7$ | 575 | 1.9 |
| $Cu_{46}Zr_{33.5}Hf_{13.5}Al_7$ | 570 | 1.9 |
| $Cu_{46}Zr_{32}Hf_{15}Al_7$ | 607 | 2 |
| $Cu_{46}Zr_{30}Hf_{17}Al_7$ | 603 | 2 |
| $Cu_{46}Zr_{27}Hf_{20}Al_7$ | 609 | 2 |
| $Cu_{46}Zr_{23.5}Hf_{23.5}Al_7$ | 651 | 2.1 |
| $Cu_{48}Zr_{31.5}Hf_{13.5}Al_7$ | 581 | 1.9 |
| $Cu_{44}Zr_{33.5}Hf_{15.5}Al_7$ | 583 | 1.9 |
| $Cu_{46}Zr_{31.5}Hf_{13.5}Al_7Ti_2$ | 592 | 1.9 |
| $Cu_{43}Ni_3Zr_{33.5}Hf_{13.5}Al_7$ | 583 | 1.9 |

In sum, the inventors discovered a new family of Cu-based bulk metallic glass forming alloys with very high critical casting thickness and processability. This enables commercial production of large cross section fully amorphous articles using Cu-based alloys.

III. Method of Making Alloys

The bulk amorphous alloys of this invention can be made by conventional metal/alloy fabrication steps/methods. Exemplary method steps include: 1. weighing constituent species (i.e. raw metals) according to the alloy composition using a precision balance; 2. cleaning the raw metals with an organic solvent, such as acetone and then ethanol in an ultrasonic cleaner for at least 5 minutes; and 3. melting the raw metals together to form a uniform alloy using an arc melting or induction furnace under protective atmosphere (e.g. ultrahigh purity Argon). Prior to melting, the furnace chamber should be evacuated with a mechanical pump, preferably followed by a high vacuum pump (e.g. turbo pump), to a low residual air pressure, e.g., $10^{-2}$ mbar, or preferably $10^{-5}$ mbar. Still preferably, the pumping process, particularly in the rough vacuum range (>$10^{-2}$ mbar residual pressure), is combined with flushing the chamber using an inert gas, and at least three cycles of pumping and flushing are conducted before starting the high vacuum pump or back-filling the chamber with an inert gas. Still preferably, a sacrificial metal, e.g. Ti or Zr, is first melted to getter the remaining oxygen after back-filling the chamber but before the raw metals for alloying are melted. Still preferably, the alloy ingot is flipped and re-melted several times in order to obtain uniform alloy chemistry.

IV. Method of Casting Alloys

The invention is also directed to embodiments of a method for casting alloys into three dimensional bulk objects, while retaining substantially amorphous atomic structure. In such embodiments, the term three-dimensional refers to an object having dimensions of at least 0.5 mm in each dimension. The term "substantially" as used herein in reference to the amorphous metal alloy means that the metal alloys are at least fifty percent amorphous by volume. The percentage of the amorphous content can be accurately determined by measuring crystallization enthalpy upon heating in a calorimeter. Preferably the metal alloy is at least ninety-five percent amorphous and most preferably about one hundred percent amorphous by volume.

Certain disclosed exemplary alloy embodiments, such as $Cu_{46}Zr_{35}Hf_{12}Al_7$, $Cu_{46}Zr_{33.5}Hf_{13.5}Al_7$ and $Cu_{46}Zr_{32}Hf_{15}Al_7$, can directly solidify into a bulk article that is substantially amorphous when the power is turned off in the melting furnace. To form an article of a specific shape, e.g. a cylinder, square rod, screw, gear, cell phone case, or laptop case, the molten alloy can be cast into a pre-made mold with the desired geometry using various casting methods, such as tilt casting, injection casting, die casting and suction casting. Alternatively, the alloy can be re-melted in a refractory mold (e.g. quartz, ceramics) and cooled together with the mold by, for example, water quenching. Preferably, such casting is performed under protective atmosphere. Still preferably, the casting chamber is subjected to at least three cycles of pumping and inert gas-flushing at the rough vacuum (>$10^{-2}$ mbar residual pressure) level, followed by high vacuum pumping to a residual pressure on the order of $10^{-5}$ mbar, prior to back-filling the chamber with the inert gas. Still preferably, the remaining oxygen after backfilling the chamber is gettered by first melting a sacrificial metal, e.g. Ti or Zr, prior to melting the alloy for casting.

A person of ordinary skill in the art will understand that the current invention is not limited to any specific choice of casting or forming methods or specific articles made of the new bulk metallic glasses.

Examples

The following examples are provided to illustrate certain features of exemplary embodiments. A person of ordinary skill in the art will appreciate that the scope of the invention is not limited to these exemplary features.

Figure 4:
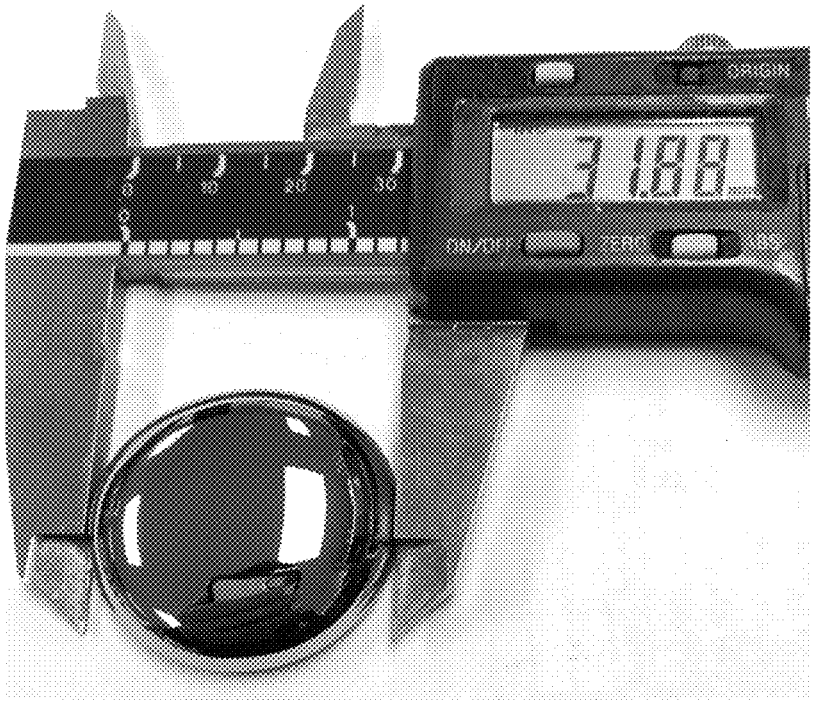
FIG. 4 is a digital image of an arbitrary-shaped ingot of an exemplary Cu—Zr—Hf—Al alloy melted and naturally solidified in an arc melting furnace.

FIG. 4 is a digital image of a large, arbitrary-shaped ingot of the alloy $Cu_{46}Zr_{33.5}Hf_{13.5}Al_7$ melted (starting from raw metals) and naturally solidified in an arc melting furnace. The natural surface of the ingot exhibits very high smoothness and optical reflectivity. The ingot without further processing is already amorphous (as confirmed by XRD) except for a thin layer at the bottom that was incompletely melted due to contact with the cold surface of the melting stage.

Figure 5:
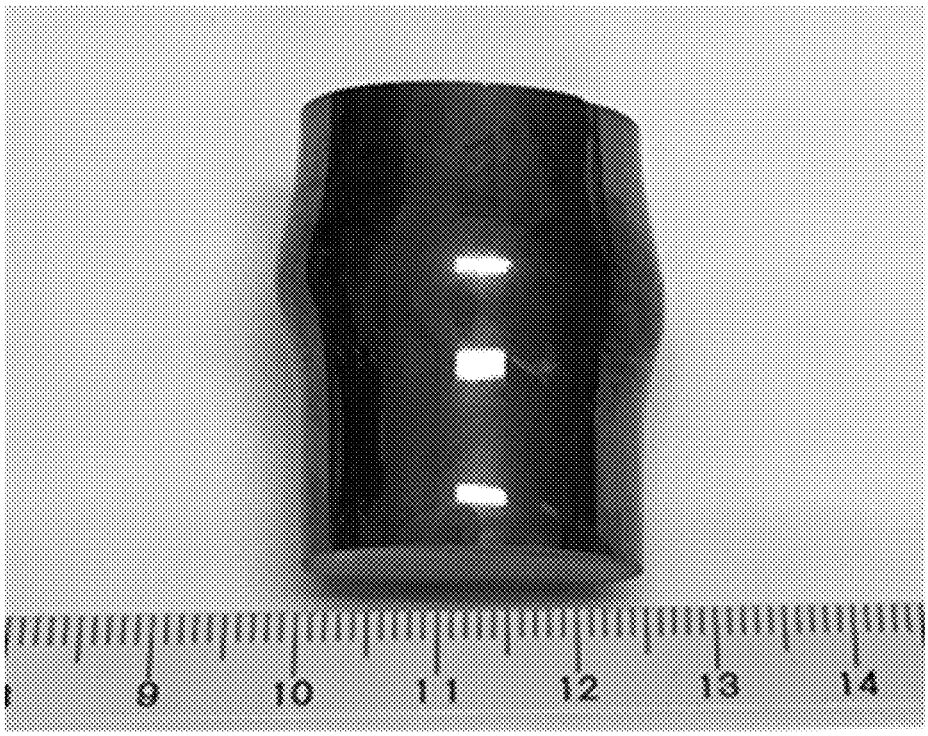
FIG. 5 is a digital image of an exemplary Cu—Zr—Hf—Al alloy rod having a 25-mm diameter (with an enlarged section up to 28.5-mm diameter) formed by induction remelting in a quartz tube and subsequent water quenching.

FIG. 5 is a digital image of an exemplary, fully amorphous 25-mm diameter (with an enlarged section up to 28.5 mm diameter) cylindrical rod of the alloy $Cu_{46}Zr_{33.5}Hf_{13.5}Al_7$ formed by re-melting in a quartz tube and subsequently water quenching. In addition, a digital image of three exemplary, fully amorphous cylindrical rods of the alloy $Cu_{46}Zr_{35}Hf_{12}Al_7$ with different diameters, 10 mm, 15 mm, 20 mm, formed by tilt casting into a copper mold is provided by FIG. 1.

Although specific exemplary alloy compositions are disclosed herein, a person of ordinary skill in the art can and will design alternative Cu-based alloys that are within the scope of the following claims.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A glass forming alloy, having a formula $$(Cu_{1-x}TM_x)_a((Zr,Hf)_{1-y}ETM_y)_b(Al_{1-z}AM_z)_c,$$

where:

TM is a transition metal selected from Mn, Fe, Co, Ni, Pd, Pt or Au;

ETM is an early transition metal selected from Ti, Y, V, Nb, Ta, Cr, Mo, or W;

AM is an additive material selected from B, Ge, Sb or Si;

a is from 43 to 49 in atomic percentage;
b is from 44 to 50 in atomic percentage;
c is from 6 to 8 in atomic percentage;
$0 \leq x < 0.2$;
$0 \leq y < 0.2$;
$0 \leq z < 0.2$;
$0 \leq x+y+z < 0.3$;
Zr content is more than 23 atomic percent; and
Hf content is more than 5 atomic percent.

2. The glass forming alloy according to claim 1 wherein the alloy has:
a ΔTsc of more than 60° C. upon heating at a rate of 5° C./minute;
a Vickers hardness greater than 550 Kg/mm$^2$;
a yield strength greater than 1.8 GPa; or
combinations thereof.

3. The glass forming alloy according to claim 1 wherein the alloy is substantially amorphous.

4. The glass forming alloy according to claim 1 wherein the alloy is three dimensional and has a size of 1 mm in each dimension or has a dimension of at least 10 mm in each dimension.

5. A cast article, comprising an alloy according to claim 1.

6. A method for making an alloy according to claim 1, comprising:
selecting raw metals to provide an alloy composition having a formula $(Cu_{1-x}TM_x)_a((Zr,Hf)_{1-y}ETM_y)_b(Al_{1-z}AM_z)_c$, where ETM is an early transition metal selected from Ti, Y, V, Nb, Ta, Cr, Mo or W; TM is a transition metal selected from Mn, Fe, Co, Ni, Pd, Pt or Au; AM is an additive material selected from B, Ge, Sb or Si; a is from 43 to 49; b is 40 to 50; c is 6 to 8 in atomic percentage; $0 \leq x < 0.2$; $0 \leq y < 0.2$; $0 \leq z < 0.2$; $0 \leq x+y+z < 0.3$; Zr content is more than 23 atomic percent; and Hf content is more than 5 atomic percent;
cleaning the raw metals with an organic cleaning agent; and
melting the raw metals together to form the alloy.

7. The method according to claim 6 wherein the organic cleaning agent is a ketone, an alcohol, or combinations thereof.

8. The method according to claim 7 wherein:
the ketone is acetone; and
the alcohol is a $C_{1-5}$ alkyl alcohol.

9. The method according to claim 8 wherein the alcohol is ethanol.

10. A casting method, comprising:
providing an alloy according claim 1; and
casting the alloy to form a cast article.

11. The method according to claim 10, wherein casting comprises tilt casting, injection casting, die casting, suction casting, or water quenching.

12. The method according to claim 10, wherein the cast article has all dimensions greater than 1 mm and is substantially amorphous in its atomic structure.

13. The method according to claim 10, wherein the cast article is substantially amorphous in its atomic structure and has all dimensions greater than 10 mm.

14. The method according to claim 10, wherein the article is selected from a cylinder, a square rod, a screw, a gear, a cell phone case, or a laptop case.

15. A casting method, comprising:
providing an alloy according to claim 1; and
casting the alloy by tilt casting, injection casting, die casting, suction casting, or water quenching, to form an article of desired geometry, wherein the cast article has all dimensions greater than 1 mm and is substantially amorphous in its atomic structure.

16. A glass forming alloy, having a formula $$(Cu_{1-x}TM_x)_a((Zr,Hf)_{1-y}ETM_y)_b(Al_{1-z}AM_z)_c,$$

where:
ETM is an early transition metal selected from Ti, Y, V, Nb, Ta, Cr, Mo, or W;
TM is a transition metal selected from Mn, Fe, Co, Ni, Pd, Pt or Au;
AM is an additive material selected from B, Ge, Sb or Si;
a is in the range of from 45 to 47 in atomic percentage;
b is in the range of 45 to 49 in atomic percentage;
c is in the range of 7 to 8 in atomic percentage;
$0 \leq x < 0.1$;
$0 \leq y < 0.1$;
$0 \leq z < 0.1$;
$0 \leq x+y+z < 0.2$;
Zr content is more than 30 atomic percent; and
Hf content is more than 11 atomic percent.

17. The glass forming alloy according to claim 16 wherein the alloy has:
a ΔTsc of more than 60° C. upon heating at a rate of 5° C./minute;
a Vickers hardness greater than 550 Kg/mm$^2$;
a yield strength greater than 1.8 GPa; or
combinations thereof.

18. The glass forming alloy according to claim 16 wherein the alloy is substantially amorphous.

19. The glass forming alloy according to claim 16 wherein the alloy is three dimensional and has a size of 1 mm in each dimension, or at least 10 mm in each dimension.

20. A glass forming alloy selected from $Cu_{46}Zr_{42}Hf_5Al_7$, $Cu_{46}Zr_{39}Hf_8Al_7$, $Cu_{46}Zr_{35}Hf_{12}Al_7$, $Cu_{46}Zr_{33.5}Hf_{13.5}Al_7$, $Cu_{46}Zr_{32}Hf_{15}Al_7$, $Cu_{46}Zr_{30}Hf_{17}Al_7$, $Cu_{46}Zr_{27}Hf_{20}Al_7$, $Cu_{46}Zr_{23.5}Hf_{23.5}Al_7$, $Cu_{48}Zr_{31.5}Hf_{13.5}Al_7$, $Cu_{44}Zr_{33.5}Hf_{15.5}Al_7$, $Cu_{46}Zr_{31.5}Hf_{13.5}Ti_2Al_7$ or $Cu_{43}Ni_3Zr_{33.5}Hf_{13.5}Al_7$.

21. A cast article, comprising an alloy according to claim 20.

* * * * *